United States Patent [19]

Müller et al.

[11] 4,314,606

[45] Feb. 9, 1982

[54] APPARATUS FOR A TREATMENT OF FLOWING MEDIA WHICH CAUSES HEAT EXCHANGE AND MIXING

[75] Inventors: Walter Müller, Kelkheim; Richard Gauer, Wiesbaden; Wilfried Walkenhorst, Königstein; Gerhard Wild, Frankfurt am Main, all of Fed. Rep. of Germany

[73] Assignee: Hoechst Aktiengesellschaft, Frankfurt am Main, Fed. Rep. of Germany

[21] Appl. No.: 73,656

[22] Filed: Sep. 10, 1979

[30] Foreign Application Priority Data

Sep. 12, 1978 [DE] Fed. Rep. of Germany ..... 2839564

[51] Int. Cl.[3] ..... F28D 7/08

[52] U.S. Cl. ..... 165/163; 165/141; 165/143; 165/154

[58] Field of Search ..... 165/109 R, 109 T, 163, 165/140, 141, 154, 143

[56] References Cited

U.S. PATENT DOCUMENTS

| | | | |
|---|---|---|---|
| 2,429,663 | 10/1947 | Beatty | 165/163 |
| 3,286,992 | 11/1966 | Armeniades et al. | 366/339 |
| 3,483,920 | 12/1969 | Heyn et al. | 165/165 |
| 3,915,224 | 10/1975 | Richter et al. | 165/163 |
| 3,991,823 | 11/1976 | Litke et al. | 165/163 |
| 4,211,277 | 7/1980 | Grosz-Röll et al. | 165/154 |

FOREIGN PATENT DOCUMENTS

| | | | |
|---|---|---|---|
| 2115570 | 10/1972 | Fed. Rep. of Germany | 165/163 |
| 2446113 | 4/1976 | Fed. Rep. of Germany | 165/154 |
| 2328795 | 9/1976 | Fed. Rep. of Germany | 138/38 |
| 1174181 | 12/1969 | United Kingdom | 165/163 |
| 1474881 | 5/1977 | United Kingdom | 165/163 |

*Primary Examiner*—Sheldon J. Richter
*Attorney, Agent, or Firm*—Curtis, Morris & Safford

[57] ABSTRACT

In an apparatus for a treatment of flowing media which causes heat exchange and mixing internal fittings are located within a housing, which internal fittings consist of tubes extending in the axial direction of the housing, each such tube containing a plurality of elbow-shaped tube portions connected by other tube portions, said tubes being arranged in parallel to one another with the connecting tube portions of adjacent tubes crossing one another.

10 Claims, 4 Drawing Figures

APPARATUS FOR A TREATMENT OF FLOWING MEDIA WHICH CAUSES HEAT EXCHANGE AND MIXING

The invention relates to an apparatus for a treatment of flowing media which causes heat exchange and mixing, which apparatus includes a tubular housing and within said housing internal fittings intended for the treatment which causes heat exchange and mixing.

Apparatus for mixing flowing media are known, in which mixing inserts are arranged in tubular housings; the said inserts serving to split up a product stream and rearrange it so as to cause mixing.

According to U.S. Pat. No. 3,286,992 the inserts consist of spiral webs, where each successive spiral, in the direction of flow, has the opposite direction of rotation to the preceding spiral.

According to German Patent Specification No. 2,328,795 the mixing inserts consist of mutually crossing plates. Each plate of these mixing inserts possesses several webs in the shape of a comb, between which slits are provided. The webs of one plate pass through the slits of the other plate.

If, in such apparatus, the outer jacket is constructed as a double jacket through which heat transfer medium flows, heat exchange can take place in addition to mixing. With the known apparatus, certain improvements are thereby achieved relative to the heat exchange rates of the empty tube. In the case of media of low viscosity this is due to the internal fittings increasing turbulence, while in the case of highly viscous media, which exhibit laminar flow, the transversely mixing rearrangement, and, in part, a steeper temperature gradient between the medium and the outer wall, are the deciding aspects. Improvements by a factor 2-4 relative to the conditions of the empty tube can be achieved. Large tube diameters cannot be realized, especially for installations with a high throughput, because, with increasing diameter, the ratio of exchange surface to volume decreases in inverse proportion to the diameter and the exchange lengths transversely to the direction of flow become large.

German Offenlegungsschrift No. 2,446,113 discloses an apparatus according to the pre-characterizing clause of Patent Claim 1, in which several groups, arranged in rings, of guide elements, the elements being uniformly distributed about the axis and dividing the stream of material to be mixed into part-streams, are fixed within a mixing chamber formed by an outer cylinder, which can be provided with a double jacket, and a cylindrical inner body arranged coaxially within the outer cylinder. The guide elements are staggered relative to one another from group to group. The inner body is of hollow construction so that a heat exchange medium can flow through it. However, a substantial increase in heat exchange rate cannot be achieved in this way.

Accordingly, using the known apparatus, mixing of fluid, in particular of viscous, materials can be achieved, but only unsatisfactory heat exchange between these materials and the heat exchange medium can be achieved, especially if the external diameter of the tube is large.

Accordingly, it is the object of the invention to provide an apparatus for a treatment of flowing media which causes heat exchange and mixing.

This object is achieved, according to the invention, if within a housing internal fittings consisting of tubes which extend in the axial direction of the housing, each such tube containing a plurality of elbow-shaped tube portions connected by other tube portions, which tubes are parallel to one another, with the connecting tube portions of adjacent tubes crossing one another.

In one embodiment, the elbow-shaped tube portions of the tubes extend as far as the housing and the connecting tube portions of adjacent tubes cross at right angles. In order to ensure transverse mixing uniformly in all directions, the internal fittings can consist of tube bundles connected in series and turned relative to one another, preferably through 90°, about the axis of the housing. The apparatus can consist of several tube sections possessing internal fittings consisting of one or more tube bundles, the tube sections being turned, preferably through 90°, relative to one another about the common axis. It is also possible for the tube sections to be turned relative to one another, or the tube bundles to be turned relative to one another, through more or less than 90°. The vessel itself can be of double-walled construction. It is possible to exert an advantageous influence on the mixing process if the elbow-shaped tube portions are provided with guide elements.

The apparatus is in principle suitable for providing a treatment, which causes heat exchange and mixing, for any fluid media. Preferably, the apparatus is used for melts, compositions, pastes or doughs which are very viscous and which must be heated or cooled, or from which additional heat generated as a result of reactions taking place must be removed, as is the case, for example, with polymerization, polycondensation and polyaddition. It is a characteristic of media of high viscosity that the material moves in laminar flow and does not undergo any convective circulation. The heat flux in either direction is solely by conduction. In order nevertheless to achieve sufficiently high heat exchange, all volume zones of the flowing medium must be kept at a close distance from the cooling surface, which is in fact achieved by the apparatus according to the invention. On flowing through the apparatus, the medium is divided up by the heat-exchanging internal fittings of the tube and is rearranged in a manner which causes mixing.

In polymerizations, for example, the uniformity of molecular weight distribution, which is critical for the properties and processability of the product, depends on the temperature level, the residence time and the rate of reaction. In order that this shall be achieved, it is necessary not only that the product should travel close to the wall but also that the layers and components should be mixed systematically with one another. If this is not the case, relatively broad residence time distributions result, due to higher velocity in the regions remote from the wall and greatly reduced velocity in the regions near the wall. This unevenness is further intensified by the fact that due to a temperature gradient in the direction of the wall, the productivity near the wall is greater, so that the velocity is reduced even more near the wall.

Using the apparatus according to the invention it is possible to deal with relatively high heat influx or outflux. In this, as has been found, it is not only the increase in surface area relative to volume, resulting from the internal fittings of the tube, but also the relatively more advantageous transfer coefficients at the tubes, compared to the outer jacket, which play a decisive role. The exchange rate per unit area is about 4–6 times greater at the tubes than at the outer jacket. Further, it has been found that the chosen design of the internal fittings not only exercises a heat-exchanging function but also a good mixing function and an advantageous influence on the uniformity of the residence time.

A further advantage of the apparatus is to be seen in the fact that units of large diameter can be constructed with the same characteristic dimensions of the internal elements, characterized, for example, by the tube diameter or by the free volume per unit volume. In an apparatus of large diameter, the same heat flux per unit area can be achieved at the same flow-through rate. Because of the uniformity of the flow conditions, the pressure loss does not increase. Results from pilot plants can be applied to large plants without risky extrapolations.

In the text which follows, the invention is explained in more detail in relation to drawings which represent merely one possible embodiment. In the drawings.

Figure 1:
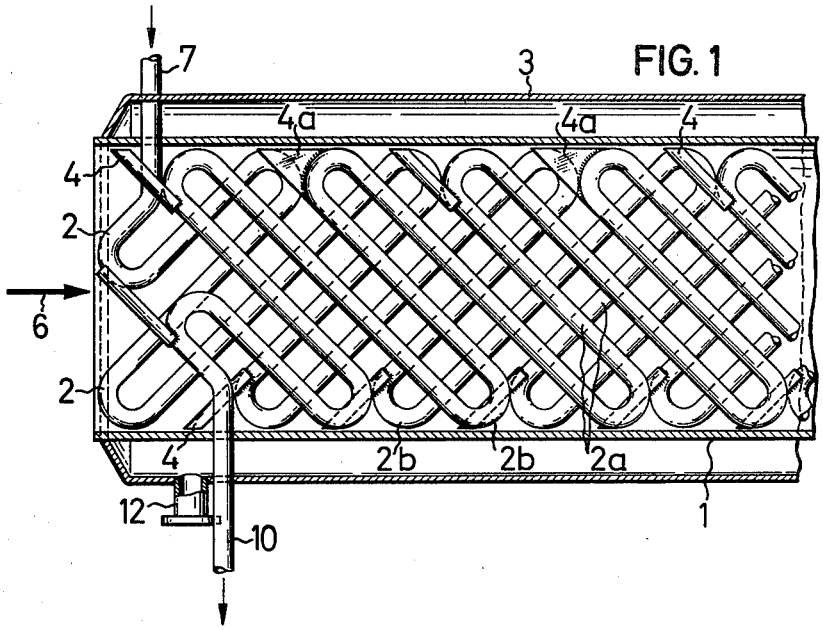
FIG. 1 shows a section along I—I of FIG. 2.
Figure 2:
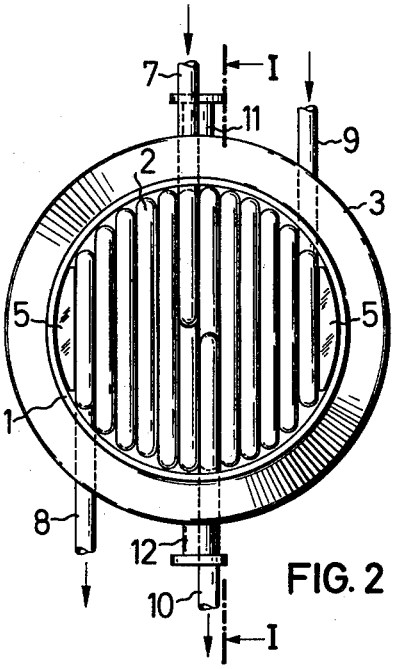
FIG. 2 shows a frontal view of the apparatus.

Internal fittings for a treatment of flowing media which causes heat exchange and mixing are arranged in the housing 1, which can be provided with a double jacket 3, the fittings consisting of tubes 2 extending in the axial direction of the housing. The tubes 2 possess connecting tube portions 2*a*, which can be rectilinear, and elbow-shaped tube portions 2*b*, which lie parallel to one another. The elbow-shaped tube portions 2*b* of a tube 2 can lie in one plane. The connecting tube portions 2*a* of adjacent tubes 2 cross, preferably at an angle of about 90°; larger and smaller angles are also possible. Each tube 2 can be provided with an inlet 7 and an outlet 10 for a heat exchange medium. For technical reasons it can be advantageous to connect the individual tubes 2 at their ends in order to have to pass the minimum number of inlets and outlets through the wall of the vessel. In the embodiment according to FIG. 2, the tubes of each half are grouped together and provided with inlets 7 and 9 and outlets 8 and 10. As a result of the arrangement of the tubes 2, the use of a housing 1 of circular cross-section results in spandrel-like spaces, into which additional elements, for example metal plates 5, can be located, unless it is inadvisable to locate an additional tube 2 therein. In the example shown, the rectilinear tube portions 2*a* of a tube 2 are parallel to one another and inclined at 45° to the axis of the jacketing tube. Other angles than 45° can also be chosen. Further, variants in which the rectilinear portions of a tube do not run parallel to one another are feasible. Adjacent tubes 2 touch at the cross-over points. An advantageous influence can be exerted on the mixing process, on the radial distribution and on the uniformity of the residence time of the flowing medium if guide elements 4, 4*a*, which may optionally be twisted, are located in the region of the curved tube portions 2*b*. 6 denotes the direction of flow of the medium which is to be treated; 11 and 12 denote orifices of the double jacket.

Figure 3:
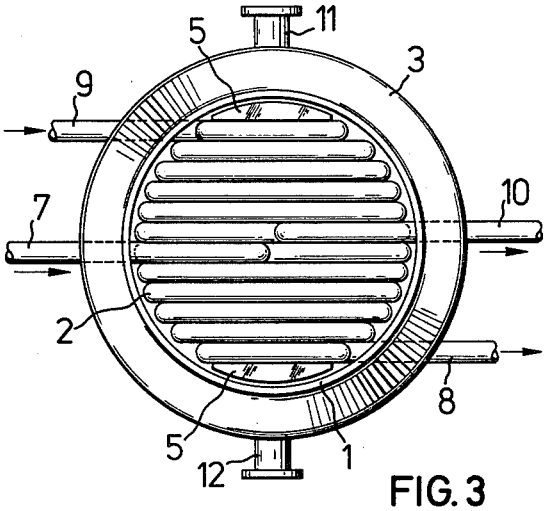
FIG. 3 shows another frontal view of suitable apparatus.

In FIG. 3 is illustrated apparatus in which the internal fittings consist of tubes 2; the tubes of the upper half of the apparatus are grouped together and connected in series, as are those of the lower half. The tubes of each half are provided with inlets 7 and 9, respectively, and outlets 8 and 10, respectively. The tubing is rotated 90° within housing 1 with reference to the orientation of the tubing shown in FIG. 2. And, as a result of the arrangement of tubes 2 in housing 1 which has a circular cross-section, spandrel-like spaces are created between the tubing and housing wall; again, additional elements, for example metal plates 5, are located in these spaces, unless it is inadvisable to locate additional tubes 2 therein. The apparatus is equipped with orifices 11 and 12 in the double jacket 3.

Figure 4:
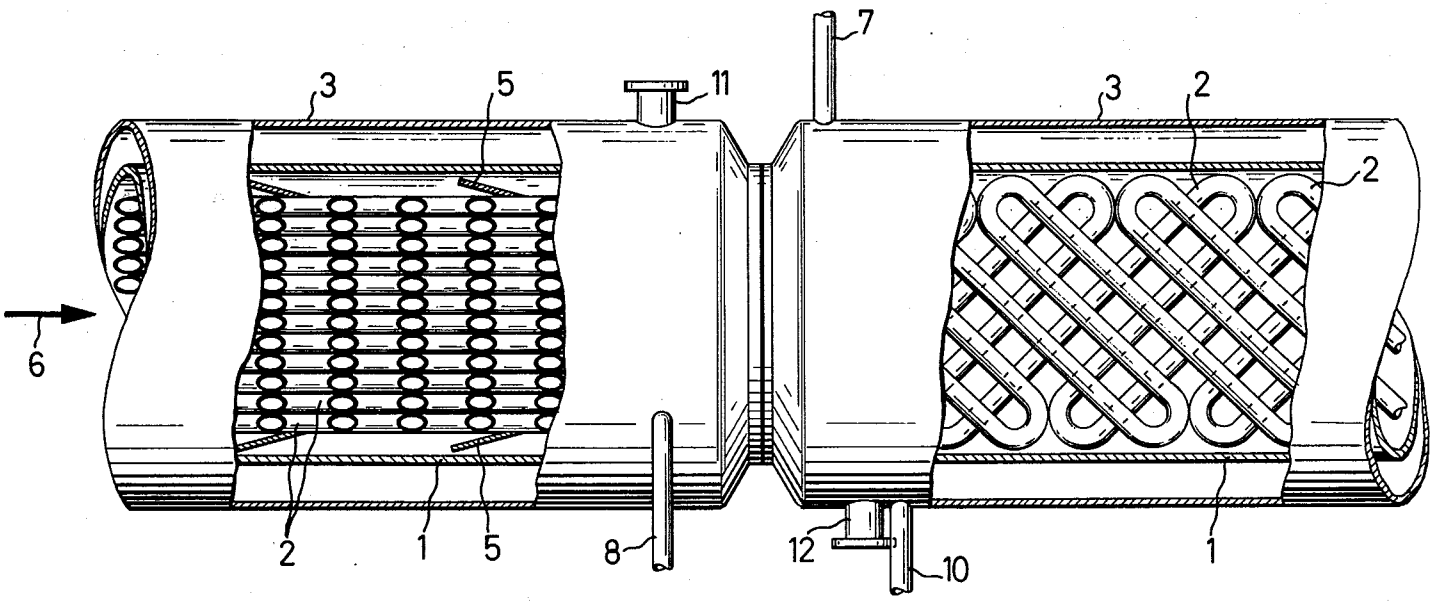
FIG. 4 shows a side view of apparatus having a plurality of tube sections.

The apparatus shown in FIG. 4 is one containing a plurality (two shown here) of tube sections. Each section has internal fittings consisting of grouped-together tubes 2; the internal fitting arrangements of each of the tube sections are identical (the illustrations of these arrangements differ due to the different rotational orientations of the tube sections vis-a-vis one another as discussed below). A view of the cross-section of the internal fitting arrangement is provided for each of the tube sections. The tube sections are rotated 90° vis-a-vis one another about their common axis and, thus, the left-hand tube section is shown to have numerous parallel tubes 2, while the illustration of the right-hand section shows that the connecting portions of adjacent tubes 2 are inclined at 45° with reference to the axis of the jacketing tube 3 and cross one another at an angle of 90°. Each of elements 7, 8 and 10 serves as an inlet or outlet, and the jacketed tube sections 3 are provided with orifices 11 and 12, respectively. Arrow 6, again, denotes the direction of flow of the medium which is to be treated.

We claim:

1. An apparatus for treatment of flowing media to cause heat exchange and mixing thereof, which includes a tubular housing and within said housing internal fittings consisting of a plurality of tubes each of which extends in the axial direction of the housing and contains elbow-shaped tube portions and other tube portions connecting the elbow-shaped portions, said tubes being arranged in parallel to one another, with the connecting tube portions of adjacent tubes crossing one another.

2. An apparatus according to claim 1, wherein in each said tube the elbow-shaped tube portions lie in one plane.

3. An apparatus according to claim 1, wherein the elbow-shaped tube portions of the tubes extend as far as the housing.

4. An apparatus according to claim 1, wherein the connecting tube portions of adjacent tubes cross at right angles.

5. An apparatus according to claim 1, wherein the internal fittings consist of bundles of tubes connected in series and rotated relative to one another about the axis of the housing.

6. An apparatus as defined in claim 5, wherein the fittings are rotated 90° relative to one another.

7. An apparatus according to claim 1, wherein the housing is of double-walled construction.

8. An apparatus according to claim 1, wherein guide elements are disposed within said housing proximate the elbow-shaped tube portions.

9. An apparatus for treatment of flowing media to cause heat exchange and mixing thereof, which comprises a plurality of tube sections, each of which sections includes a tubular housing and within said housing internal fittings consisting of a plurality of tubes grouped together into one or more bundles, each of which tubes extends in the direction of the longitudinal axis of the housing and contains elbow-shaped tube portions and other tube portions connecting the elbow-shaped portions, said tubes being arranged in parallel to one another, with the connecting tube portions of adjacent tubes crossing one another, and each said tube section being rotated relative to each next-adjacent tube section about the common axis of said tube sections.

10. An apparatus as defined in claim 9, wherein each said tube section is rotated 90° relative to each said next-adjacent tube section.

* * * * *